US007861332B2

(12) United States Patent
Sumpton et al.

(10) Patent No.: US 7,861,332 B2
(45) Date of Patent: Jan. 4, 2011

(54) SINK ACCESS DEVICE FOR A PUBLIC RESTROOM

(76) Inventors: Paul Sumpton, 713 Preston Woods Trail, Atlanta, GA (US) 30338; Joi Sumpton, 713 Preston Woods Trail, Dunwoody, GA (US) 30338; John Evans, 96 Mount Vernon Cir., Atlanta, GA (US) 30338

( * ) Notice: Subject to any disclaimer, the term of this patent is extended or adjusted under 35 U.S.C. 154(b) by 0 days.

(21) Appl. No.: 12/798,249

(22) Filed: Apr. 1, 2010

(65) Prior Publication Data

US 2010/0193292 A1 Aug. 5, 2010

Related U.S. Application Data

(63) Continuation of application No. 11/327,964, filed on Jan. 9, 2006, now Pat. No. 7,716,757.

(60) Provisional application No. 60/642,349, filed on Jan. 7, 2005, provisional application No. 60/733,096, filed on Nov. 3, 2005.

(51) Int. Cl.
*A47K 3/022* (2006.01)
*A61H 35/00* (2006.01)

(52) U.S. Cl. ..... 4/621; 182/35

(58) Field of Classification Search ..... 4/621; 182/35, 91

See application file for complete search history.

(56) References Cited

U.S. PATENT DOCUMENTS

| | | | | | |
|---|---|---|---|---|---|
| 2,570,865 | A | * | 10/1951 | Sabo | 4/621 |
| 2,599,529 | A | * | 6/1952 | Harvey | 4/621 |
| 2,738,987 | A | * | 3/1956 | McDonald | 182/91 |
| 2,746,664 | A | * | 5/1956 | Strmic | 4/638 |
| 2,881,040 | A | * | 4/1959 | Hartridge | 182/35 |
| 3,986,503 | A | * | 10/1976 | Le Guillon | 182/89 |
| 4,135,604 | A | * | 1/1979 | Ryan | 182/91 |

* cited by examiner

*Primary Examiner*—Khoa D Huynh

(57) ABSTRACT

The present invention relates to a sink access device which is utilized to facilitate a child or a diminutive person to wash their hands at a lavatory located in a public restroom. The sink access device includes a step support mount having a base and an upwardly extending arm. The step support mount is fixedly attached to a portion of a public restroom. A step is pivotally mounted to the upwardly extending arm of the step support mount. The step has a first position wherein the step is in a vertical position and a second position wherein the step is in a horizontal position providing a platform for a diminutive person to step onto. The step is positioned either at or behind a vertical plane defined by the front profile of a sink when the step is in the first position and the step breaks the plane when in the second position.

3 Claims, 16 Drawing Sheets

SINK ACCESS DEVICE FOR A PUBLIC RESTROOM

PRIORITY APPLICATIONS

This application is a continuation of U.S. patent application Ser. No. 11/327,964 with a filing date of Jan. 9, 2006 now U.S. Pat. No. 7,716,757 which claims priority from U.S. Provisional Patent Application Ser. No. 60/642,349 filed Jan. 07, 2005 and U.S. Provisional Patent Application Ser. No. 60/733,096 filed Nov. 3, 2005, all of which are incorporated herein in their entirety.

BACKGROUND OF THE INVENTION

1. Field of the Invention

The present invention relates to a pivoting step which is utilized to facilitate a child or a diminutive person to wash their hands at a lavatory located at a public restroom.

2. Description of Related Art

Restroom utilization is typically a daily routine for just about everyone, whether at home, work, shopping, or eating out. However, restroom designs are not standardized and are typically inadequate. The flux of the inconsistencies of restrooms has prompted, among other things, the formation of the American Restroom Association, which discusses various aspects of restrooms at www.Americanrestroom.org. The mission statement for the American Restroom Association includes the advocation for the availability of clean, safe, well-designed public restrooms which includes restroom design and technology, restroom availability, pertinent legislation and regulations, and increasing research related to the problems faced by people who hesitate to travel or who avoid activities that put them out of range of proper toilet facilities. Since there is no standardization of restrooms, almost all states adopt comprehensive consensus code that contains language, requiring toilet facilities for customers, patrons and visitors. This code is then enacted statewide, or where not mandated, is often adopted voluntarily at the municipal level. Of related interest, the formulas that describe the required minimum number of toilets are being updated to reflect ongoing issues. With a few exceptions, states adopt either the International Plumbing Code (IPC), the Uniform Plumbing Code (UPC) or the National Standard Plumbing Code (NSPC). While these codes typically are concerned with identifying issues regarding the number of restrooms and lavatories which must be present depending upon accessibility and the size of the public establishment, these codes are deficient in identifying specific requirements to standardization of rest rooms. For instance, while there is a trend for hands-free operation of toilets, lavatories and the like, these are merely incorporated into restrooms at the discretion of the proprietor of the public facility and are not mandated by any legislation. Accordingly, while restrooms are required to meet certain standards so that they can be utilized by everyone, they are not necessarily designed for everyone. In fact, until recently, handicapped individuals experienced great hardship in utilizing public restrooms until legislation to eliminate these hardships was put into place by the passage of the Americans with Disabilities Act ("ADA"). Accordingly, since the utilization of public restrooms is a common occurrence, their designs should include access for everyone. For the purposes of this patent application, "restroom" is defined as a room equipped with toilets and lavatories for public use.

The impact of the construction of toilets has led to the establishment of international meetings regarding issues surrounding public restrooms. In 2005, conventions were held in Belfast, Ireland and Shanghai, China, and in 2006 conventions are scheduled for Moscow, The Russian Federation, and Bangkok, Thailand, with the conference in Moscow including issues relating to children's utilization of public restrooms.

In addition to the adequate presence of restrooms, the overall construction and condition of restrooms is also important to the public. A recent survey conducted by the International Facility Management Association, www.ifma.org, indicated that besides a public building's front entrance, its restrooms have the greatest potential to negatively impact a visitor's impression of a facility. Also, durability, cleanliness and ADA compliance were highly regarded characteristics of restrooms. Of the respondents to the survey, nearly three-quarters believed that their restrooms were the most frequently visited common area of the building. Key findings from the survey indicated that issues regarding the restrooms were as frequent as other prime issues such as parking and temperature. In particular, customers were most concerned with restroom cleanliness and indicated hands-free sensor technology is the most popular design trend. Accordingly, the experience which the public has with a particular establishment's restroom will greatly affect that individual's perception of that establishment.

The interrelationship between the public and restrooms is so intertwined that not only is the location of restrooms important but also their accessibility, interactivity and safety. For instance, at a meeting at the School of Architecture and Planning at the University of Buffalo regarding utilization of public amenities, certain key attributes for restrooms was discussed. Such guidelines regarding the design of restrooms included the physical design, such as the floor surfaces draining and drying quickly; the provision of the automatic flush plumbing and changing tables for babies; hooks for coats at or below 48 inches, and other ergonomically friendly features.

However, with all of the attention placed on restrooms and their "friendliness" to the public, a major problem with restrooms currently exists. Namely, lavatories are too high for children, toddlers and diminutive persons to utilize. This is especially a problem because many lavatories have installed infrared devices to trigger the faucet to turn on. Hence, while parents go to public places with their children such as museums, aquariums, zoos, and restaurants, the lavatories and sinks at these public restrooms are too high for the child to use without assistance from a parent. Accordingly, a parent has to pick up a toddler and hold them prone over a sink countertop to enable the toddler to wash its hands. Inevitably, the toddler gets its clothing wet due to the water left on the countertop from previous usage by an adult. To perform this maneuver, the parent typically has to place a diaper bag or other item which he is typically carrying onto the lavatory floor, pick up the toddler, and then place the toddler back down. As toddlers mature, their weight can approach forty pounds and more, but they are still too short to utilize the lavatory. Such toddler weight is too heavy for some parents, and in some cases, the parent may injure himself picking up and orienting the toddler over the sink.

While portable step stools are known to increase a person's height for various reasons, these portable step stools are generally only utilized at home so they may be conveniently stored and utilized. These stools are too cumbersome for travel, especially with a small child or toddler. However, when away from home, children also need to utilize the lavatories in public places such as stores, restaurants, aquariums, zoos, parks, airports and the like, and accordingly, there is a need for a way to enable toddlers and diminutive persons to have access to a sink at a public restroom.

Accordingly, it is an object of the present invention to provide a booster step for children/toddlers and diminutive persons to enable the individual to utilize a sink in a public facility.

It is also an object of the present invention to provide a booster step that is accessible for children/toddlers and diminutive persons while also being out of the way of taller individuals, so that their utilization of a sink in a public facility is not impeded.

DESCRIPTION OF THE DRAWINGS

The construction designed to carry out the invention will be hereinafter described, together with other features thereof.

The invention will be more readily understood from a reading of the following specification by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

FIGS. 1-3A illustrate a sink access device A in relation to a sink B in the sink access device is intended for use by a diminutive person, such as a child, in positioning the child who was originally unable to approach and utilize a sink into position for utilization of the sink. In this description, a child is in reference to any diminutive person who is unable to access a sink of a particular height without assistance.

Figure 1:
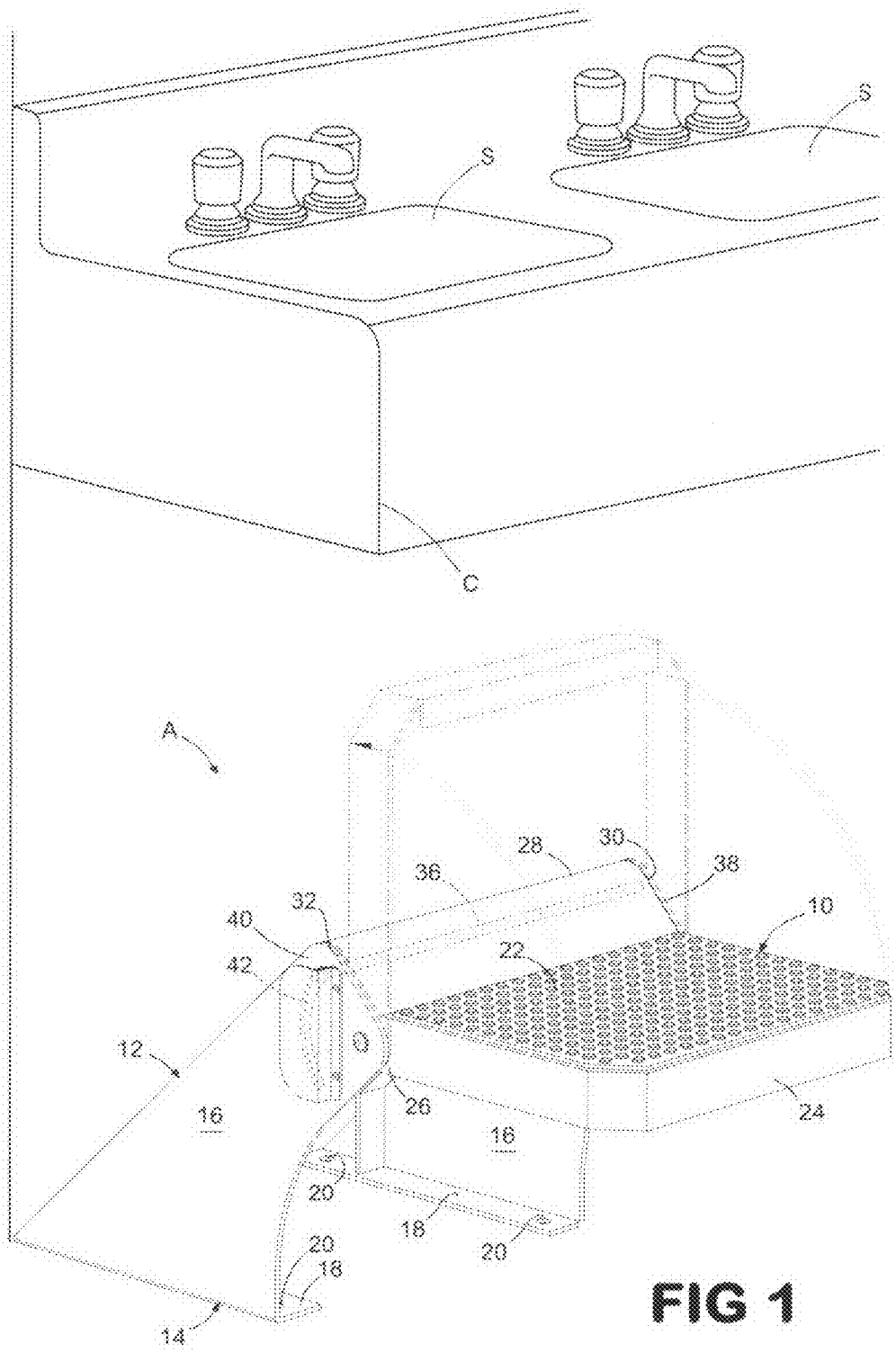
FIG. 1 is a prospective view of a sink access device according to the present invention positioned beneath a sink for supporting a diminutive person.
Figure 2:
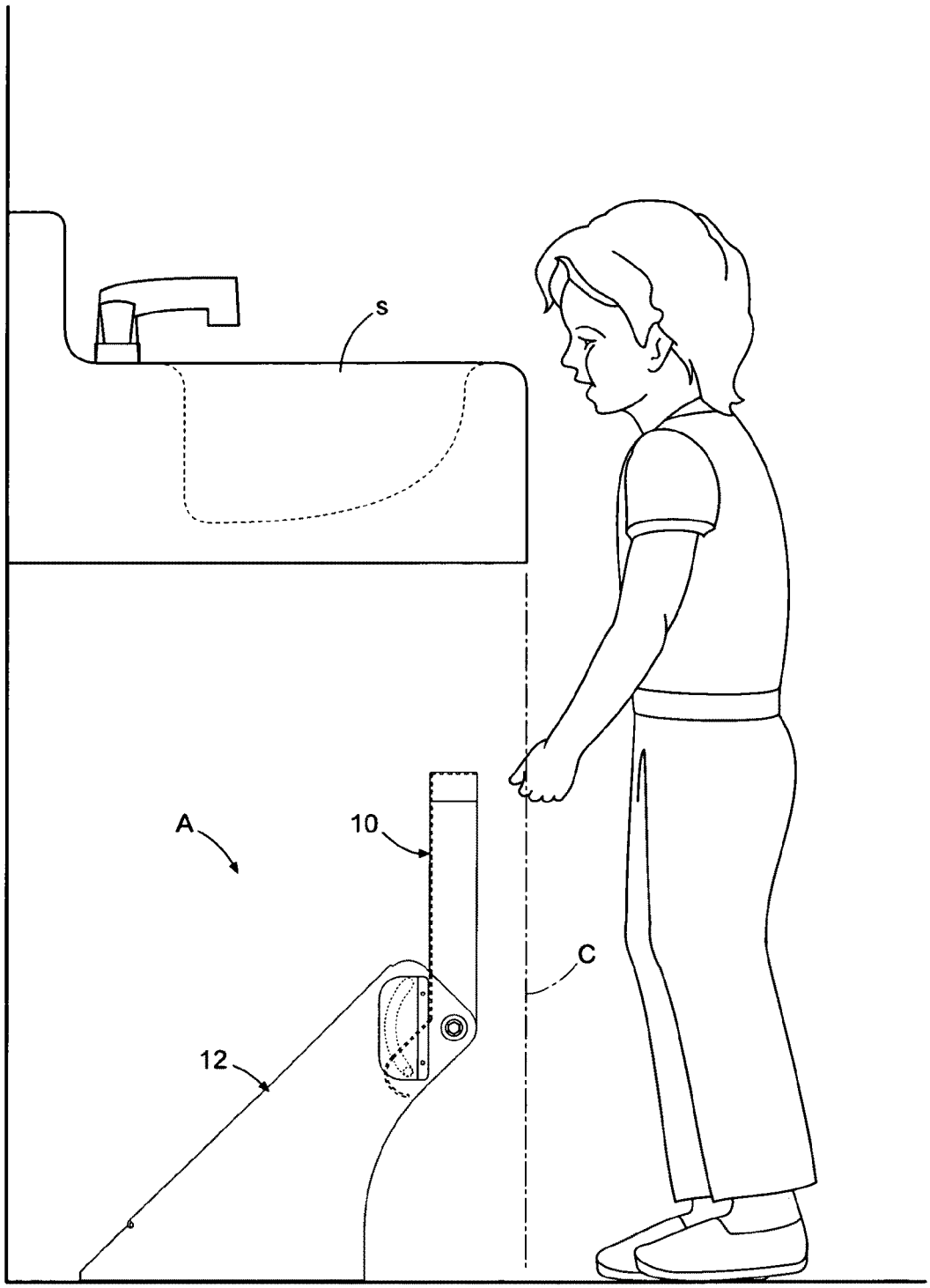
FIG. 2 illustrates the sink access device in a ready position on the sink for utilization by a diminutive person in stepping up to the sink for utilization of the sink.
Figure 3:
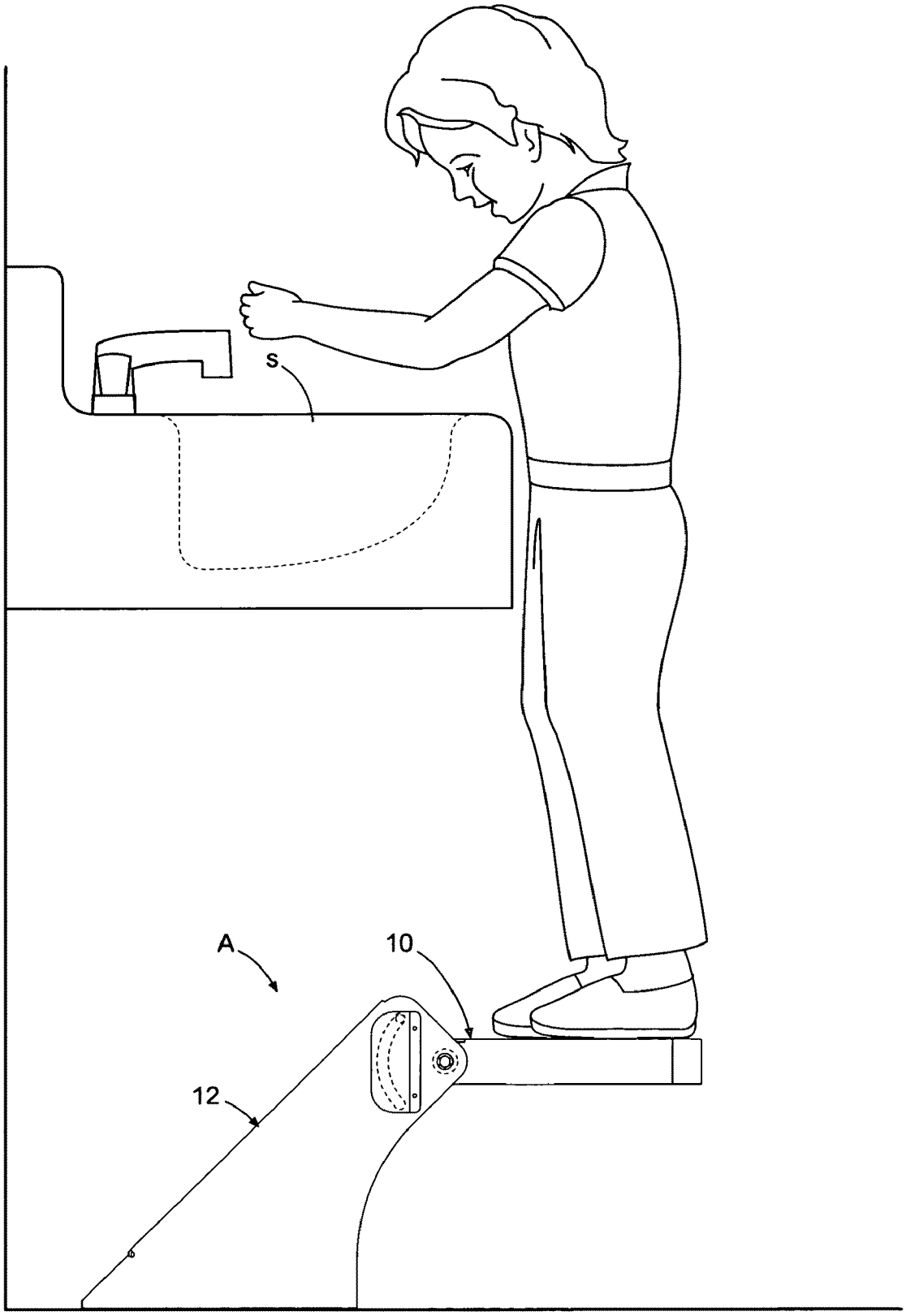
FIG. 3 illustrates a diminutive person positioned on a sink access device for utilization of a sink.

As shown in FIGS. 1, 2 and 3, the sink has a general profile defined by the outer portion of the sink. This outer profile C may be defined by the sink itself or by a cabinet surrounding the sink which is commonly found at public restrooms. Hereinafter, the reference to the term "sink" means the sink, lavatory itself, or associated carpentry such as a countertop or vanity, wherein the sink is housed or carried.

The critical aspect of the invention is that the sink access device is located within the profile of the sink. As used herein, the corresponding relationship of the sink access device with the profile of the sink is such that the term "within" implies that the attachment portion to which the step is associated does not break the plane as defined by the outer boundary of the profile of the sink identified as C, or the respective carpentry hosting the sink.

As shown in FIG. 1, the sink access device A includes a step 10 which is pivotally mounted to a step support mount 12. In this embodiment, step support mount 12 includes a base 14 and an upwardly extending arm 16. The step support mount is fixedly attached to the corresponding structure of the restroom. Preferably, the step support is only mounted with the floor of the restroom. The step unfolds from a first position wherein the step is either in back of or aligned with the profile of the sink and out of the way for normal sized individuals for utilizing the sink to a second position wherein the step is folded down, thereby breaking the plane of the sink and placing the step in position for a child to access the step, elevating themselves to a position for utilization of the sink as shown in FIG. 3.

Accordingly, in operation is shown in FIGS. 1-3, the sink access device A is in a position wherein the step 10 is raised, unimpeding access to the sink by a person utilizing the sink. As shown in FIG. 2, as a child approaches the sink access device, they may access the step such that the step is folded downward in the second position, wherein the step is located at sufficient height enabling a small child to step onto the step and be elevated to a height approximately equal to the sink for access to the sink. In the preferred embodiment, step 10 is approximately twelve inches in height.

A critical aspect of the invention is that the support mount 12 is anchored such that the step may only rotate between the first and the second position. The anchoring of step support mount 12 is accomplished by utilizing a base flange 18 with attachment apertures 20 for receiving bolts, or the like, thereby securing the step support mount 12 with the restroom floor of the particular establishment where the sink is located.

The sink access device illustrated in FIGS. 1-4 includes step 10 having a generally horizontal stepping surface 22 having a front portion 24 and a rearward portion 26 when in the horizontal second position. Step 10 also includes at least one step traveling arm 28 carried by the rearward portion. Preferably a right step traveling arm end 30 and a left step traveling arm end 32 is provided.

As shown in FIGS. 1-4, upwardly extending arm 16 carries a travel stop for engaging step traveling arm 28. In the preferred embodiment, as the step moves from the vertical position to the horizontal position providing a platform for a person to step on, step traveling arm 28 engages the travel stop positioning the step in the horizontal position. In the preferred embodiment, each upwardly extending arm 16 carries a travel stop. Also preferably, each arm includes an upper travel stop 34 and a lower travel stop 36. In one embodiment, the travel stops 34 and 36 are disposed as ends of travel slot 42 enabling the travel arm to move within the travel slot from a lower position to an upper position abutting the upper travel stop 34 for limiting the downward movement of the step when moving from the vertical first position to the horizontal second position thereby stopping the step in the horizontal position. Additionally, the travel arm is capable of traveling within the travel slot from an upper position to a lower position abutting the lower travel stop 36 for limiting the upward movement of the step from the second horizontal position to the vertical first position wherein the front end of the step is behind or in alignment with the plane defined by the front edge of the sink. For safety purposes, in the preferred embodiment, a travel slot cover 50 is carried by the respective step attachment arms for covering the respective travel slot, preventing fingers from being pinched. The drawings merely illustrate the preferred embodiment of utilizing upper and lower stops on both arms, however other configurations are possible.

Figure 3A:
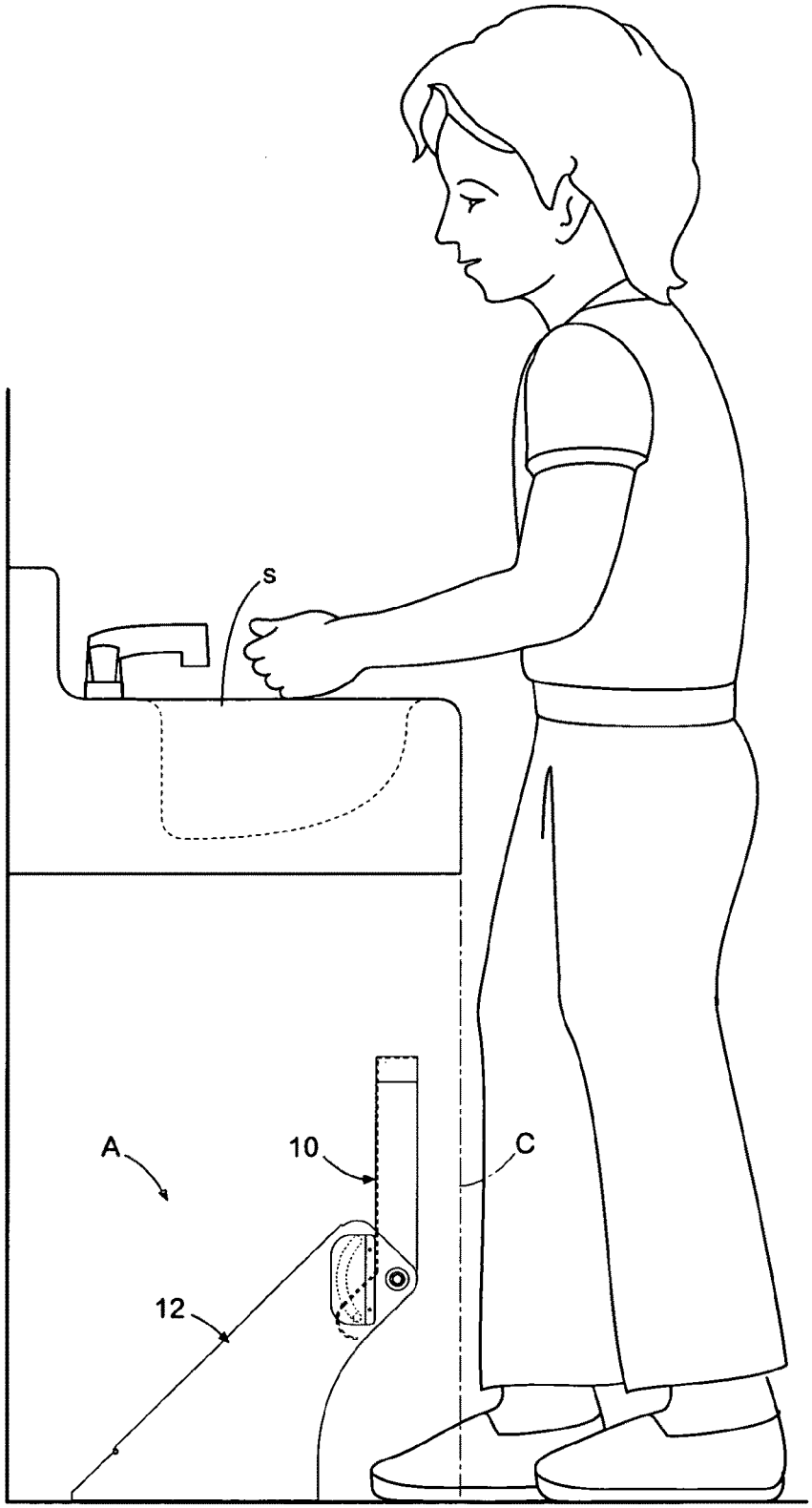
FIG. 3A illustrates another person in position for utilization of the sink where the sink access device of the present invention is ready in position for a diminutive person in an unimpeding position for a larger person.
Figure 4:
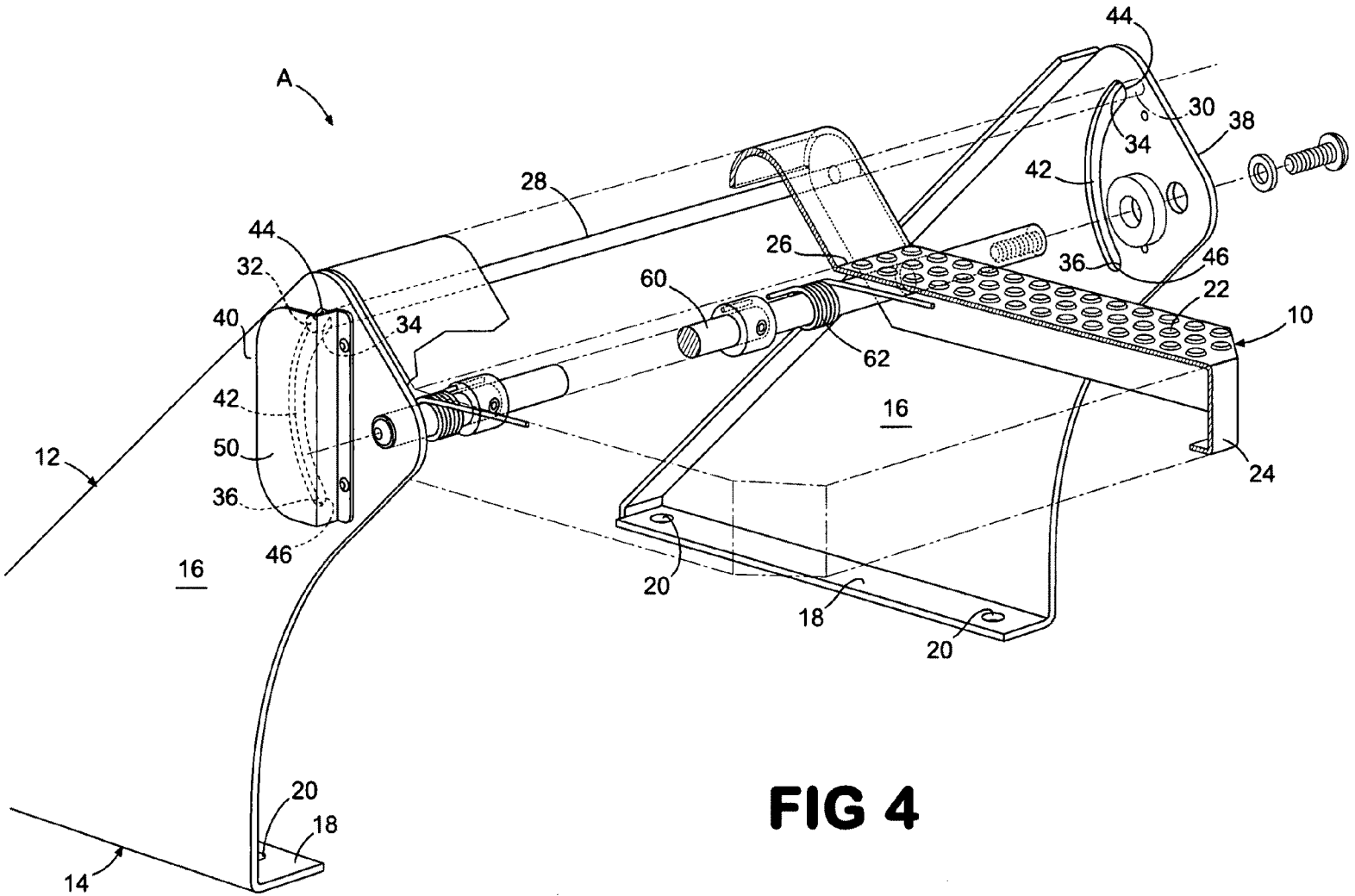
FIG. 4 is an exploded view of a sink access device of the present invention.
Figure 5:
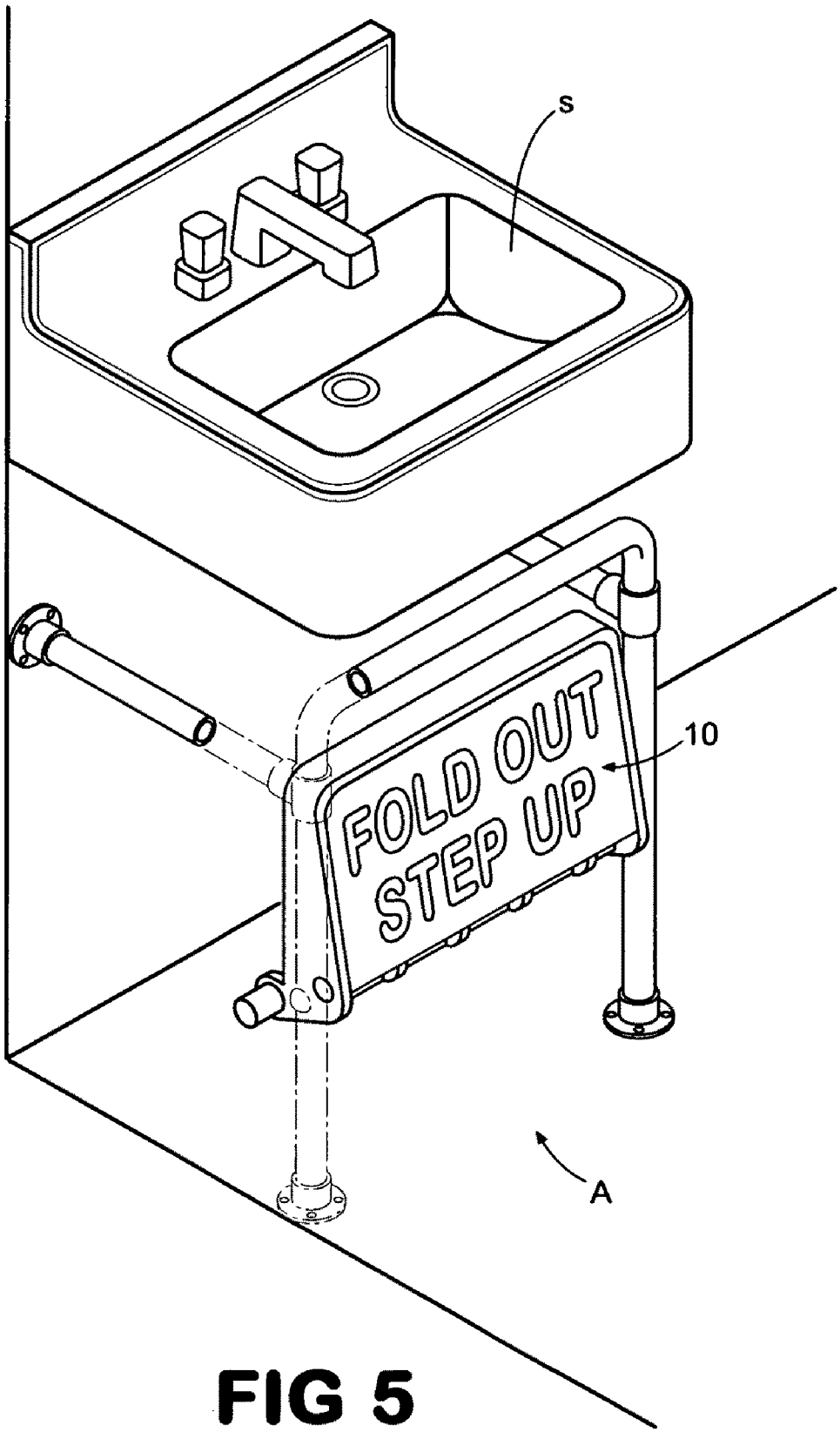
FIG. 5 illustrates an additional embodiment of a sink access device located within the periphery of a sink according to the present invention.
Figure 6:
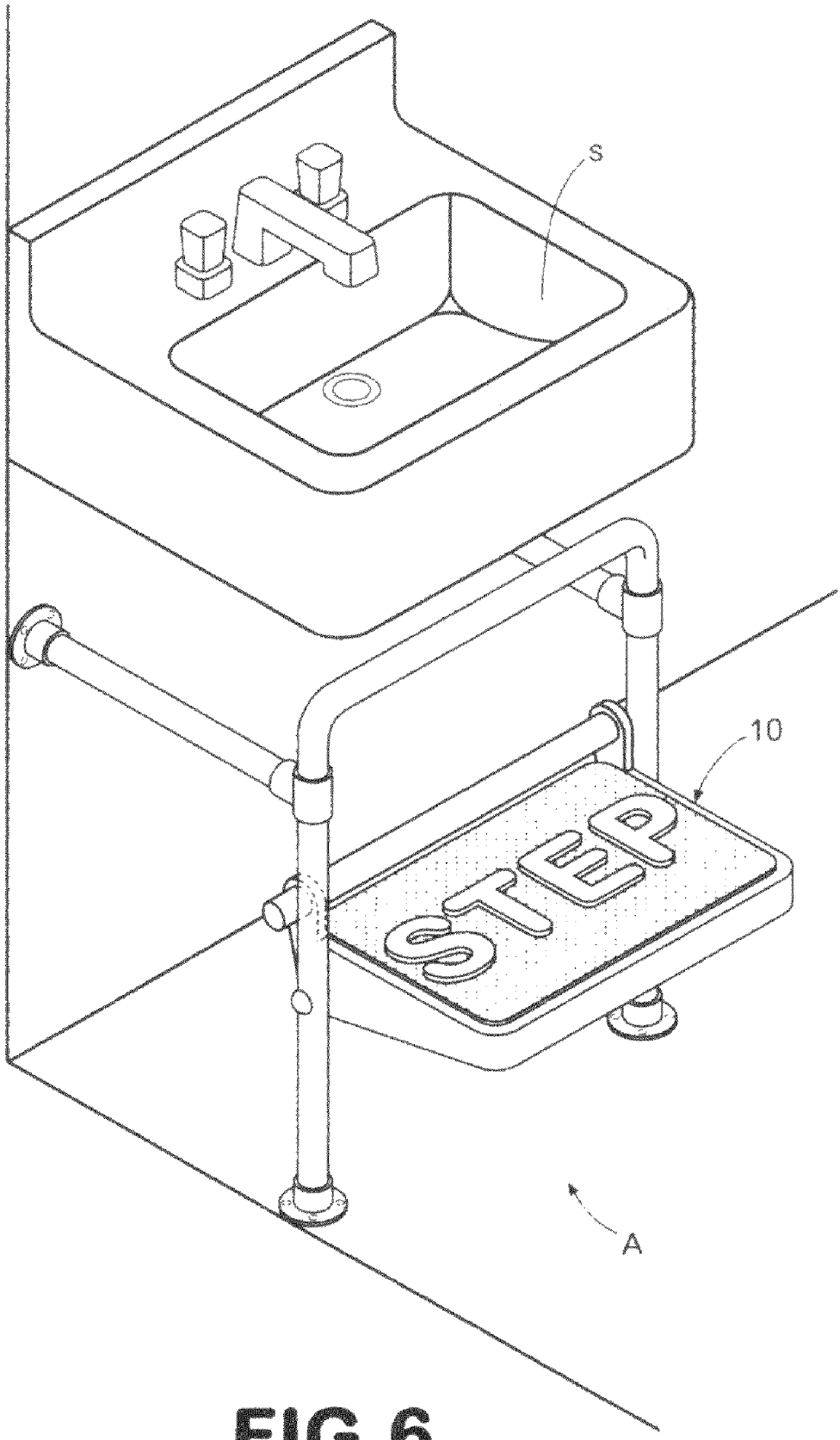
FIG. 6 identifies the alternate embodiment as shown in FIG. 5 in a ready to be utilized position to assist a diminutive person in washing their hands at a sink.
Figure 7:
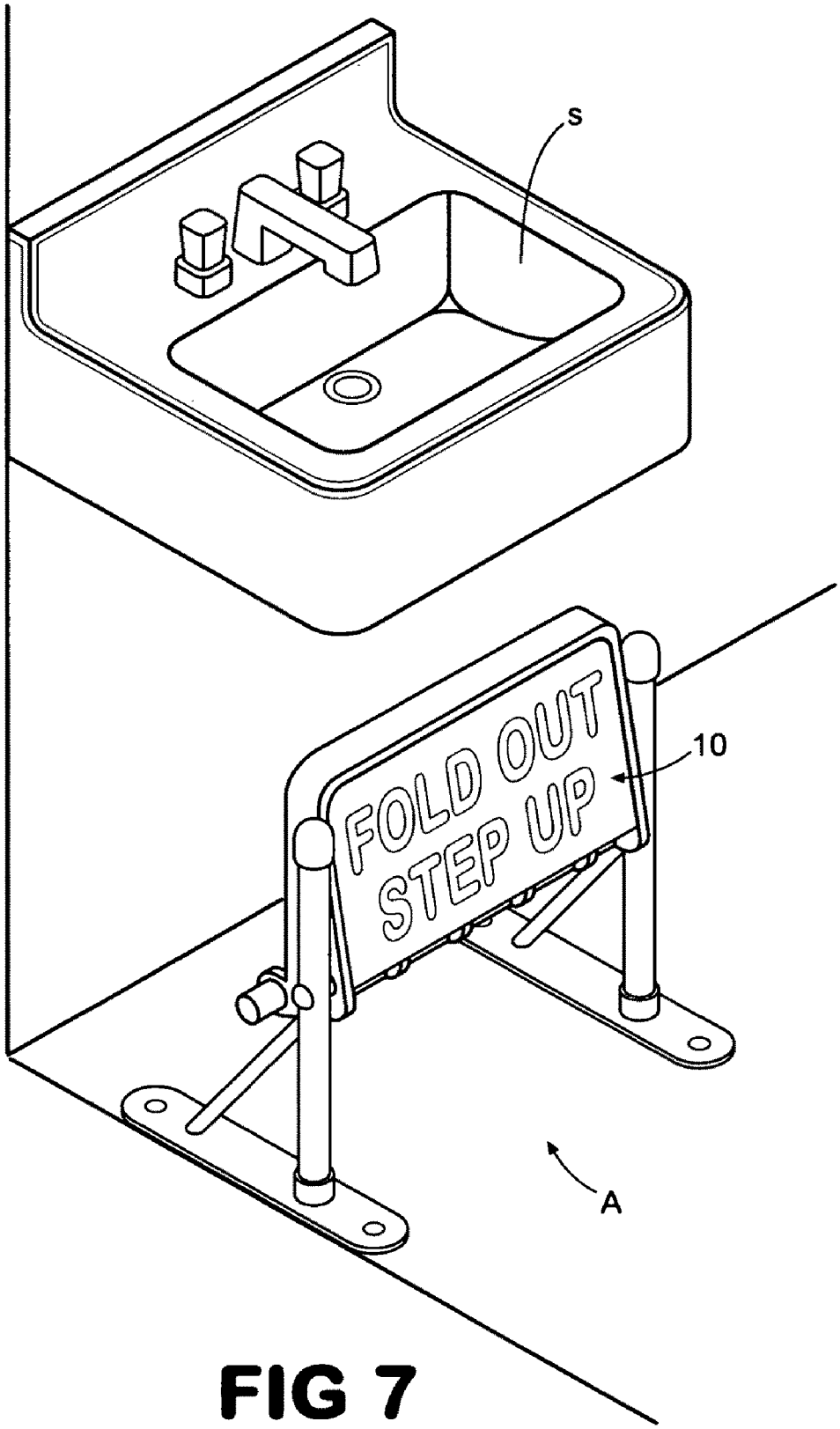
FIG. 7 identifies a third embodiment of a sink access device in a ready position for being utilized by a diminutive person for access to a sink.
Figure 8:
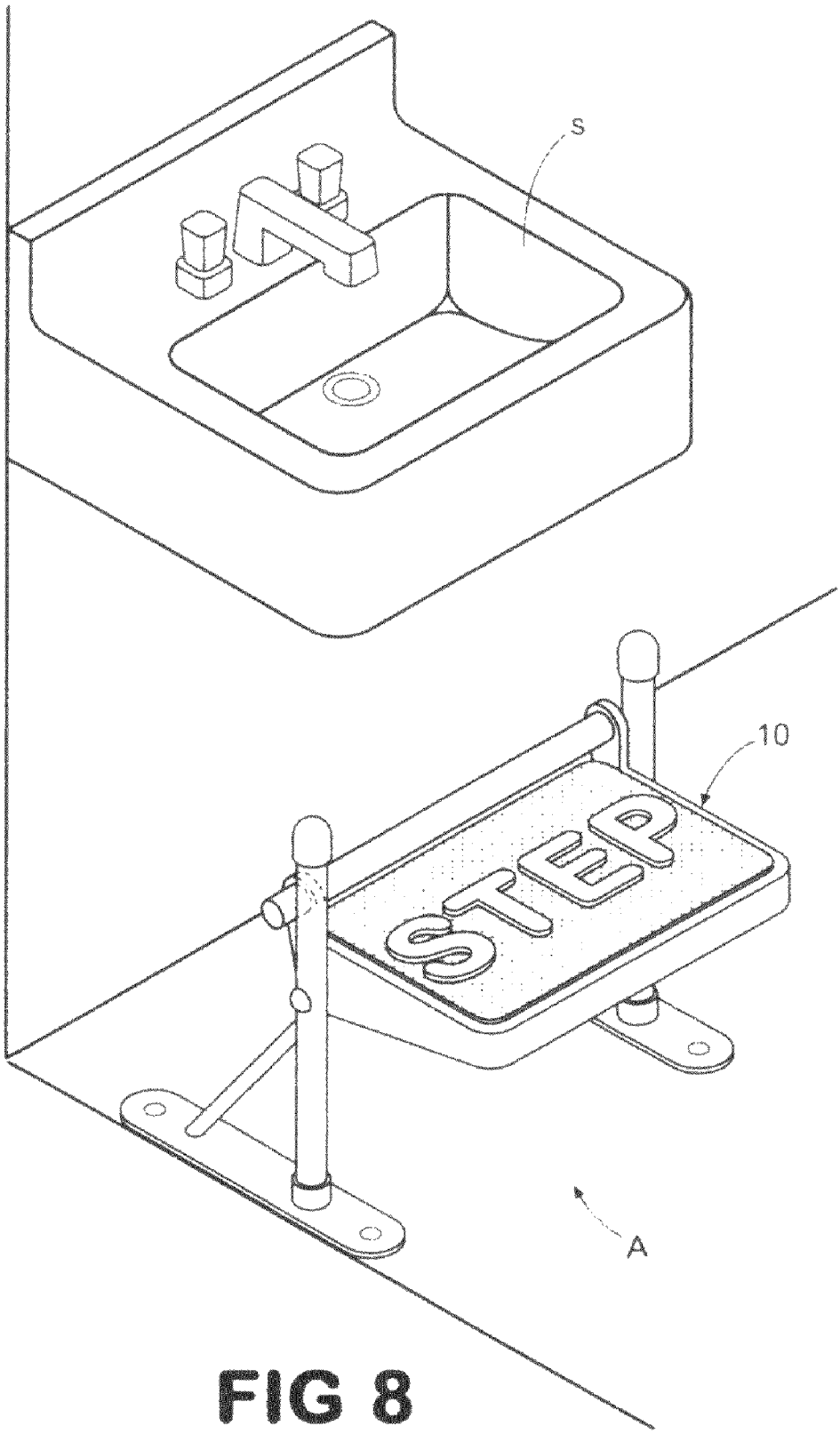
FIG. 8 illustrates the step configuration of FIG. 7 in a ready position for a diminutive person to utilize the sink.
Figure 9:
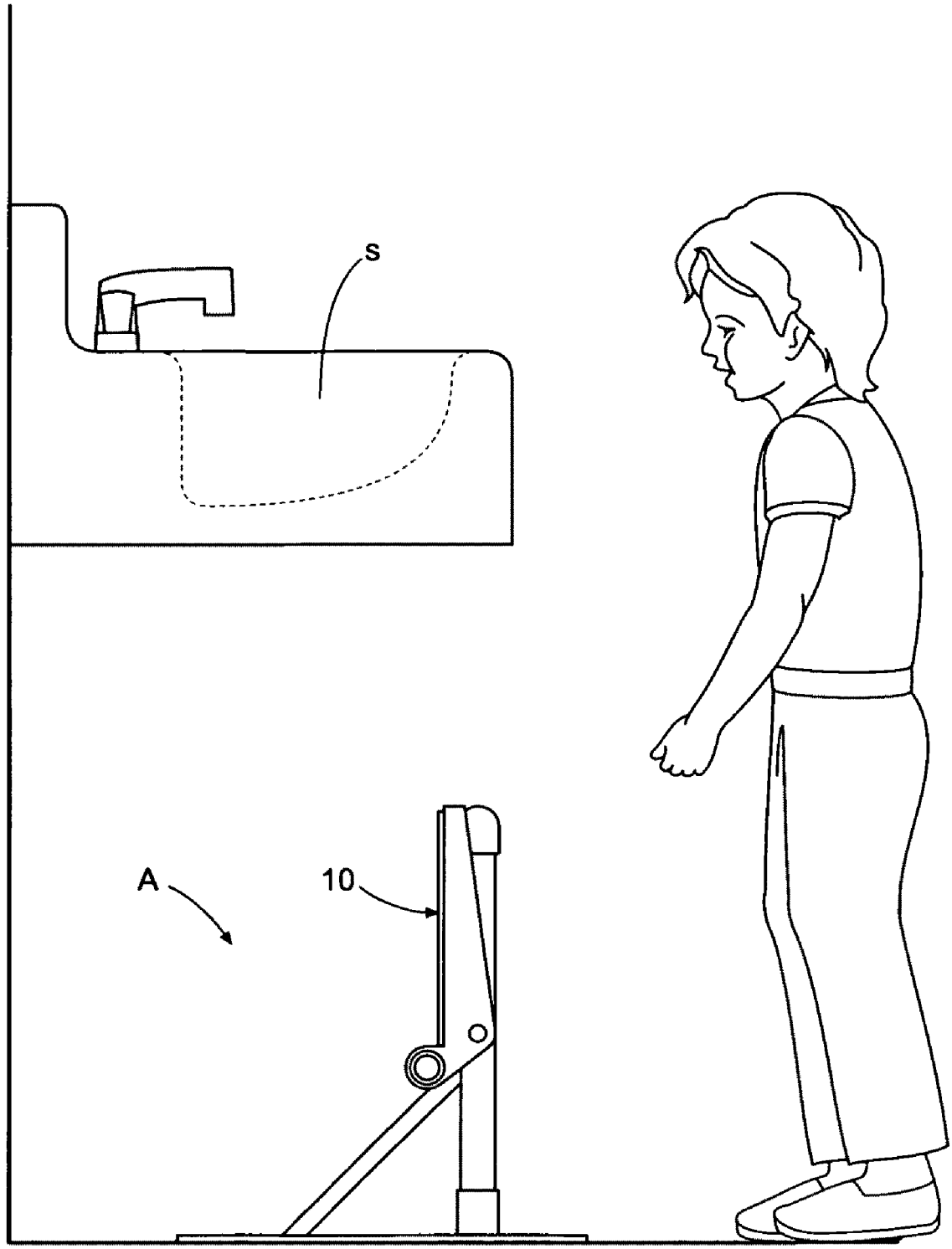
FIG. 9 illustrates a diminutive person and a sink access device of the embodiment shown in FIG. 7 according to the present invention.
Figure 10:
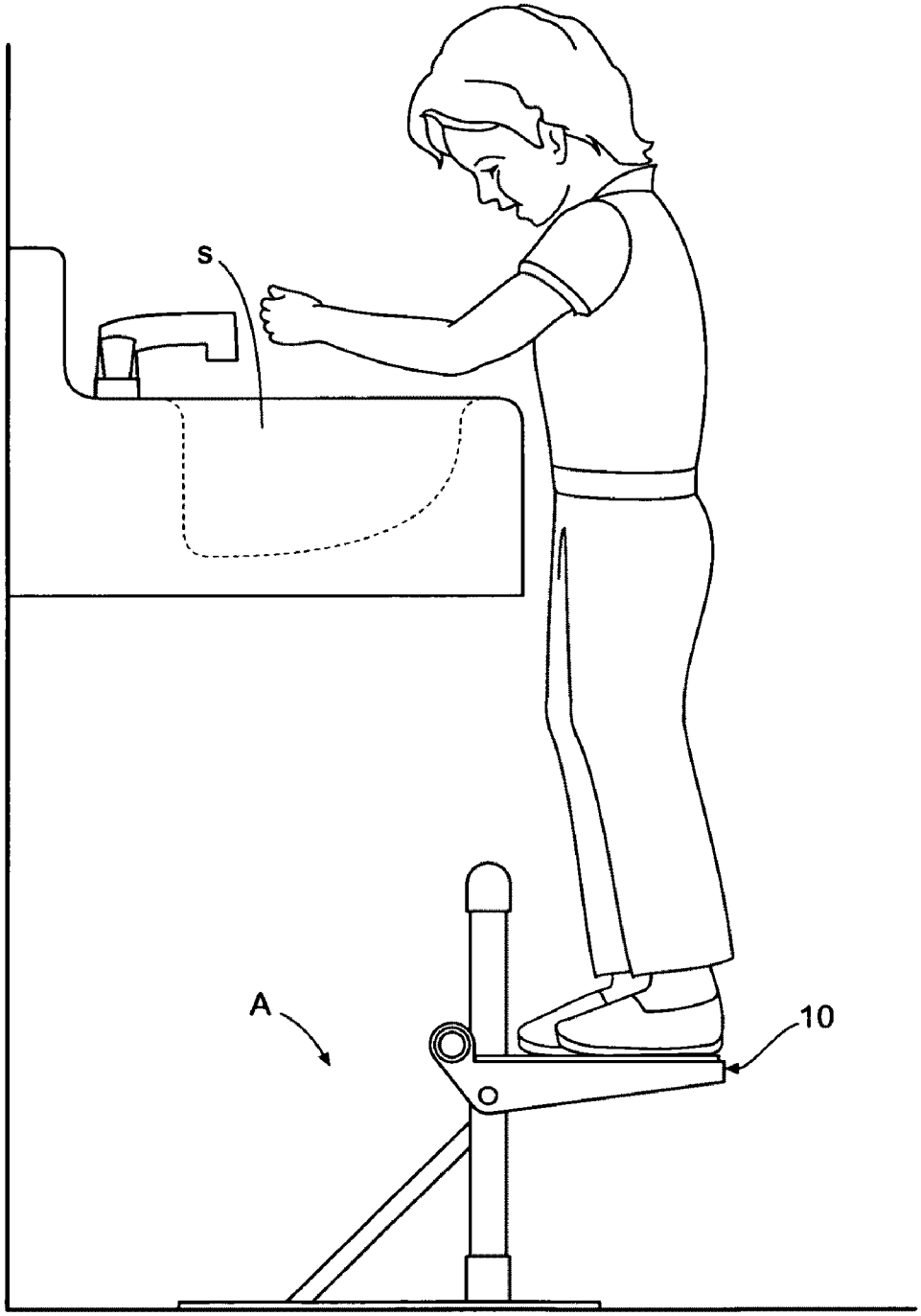
FIG. 10 illustrates a diminutive person stepping on to the sink access device for access to a sink, according to the present invention.
Figure 11:
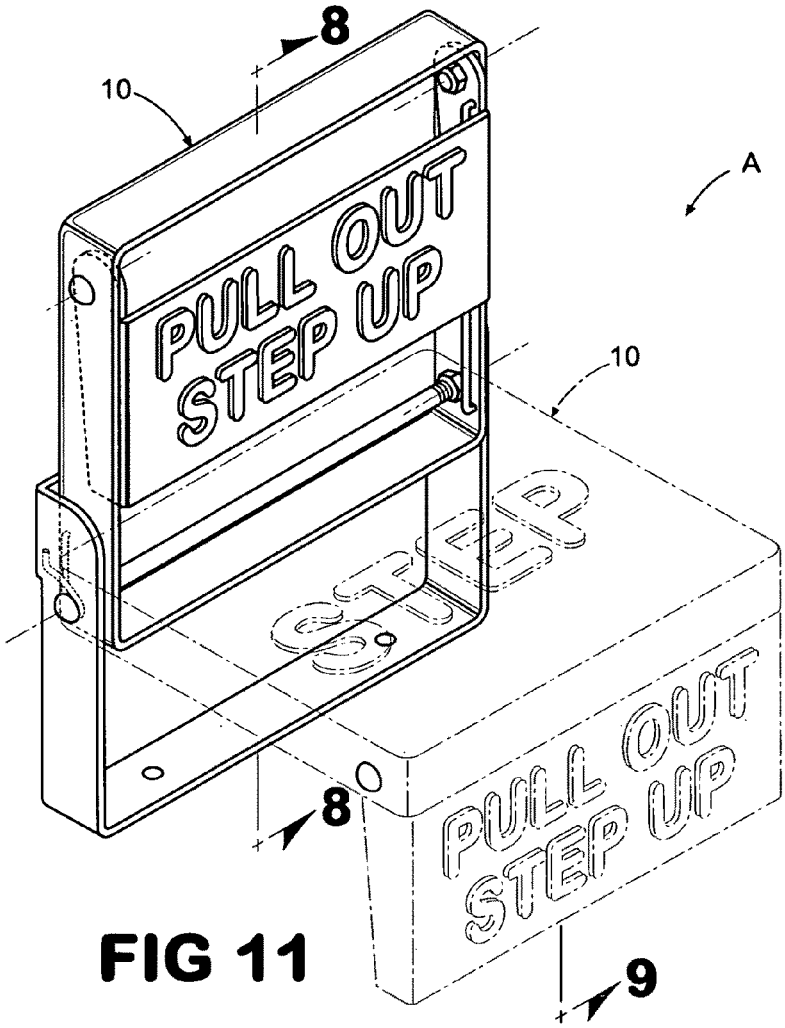
FIGS. 11, 12 and 13 identify a fourth embodiment of sink access device according to the present invention.
Figure 12:
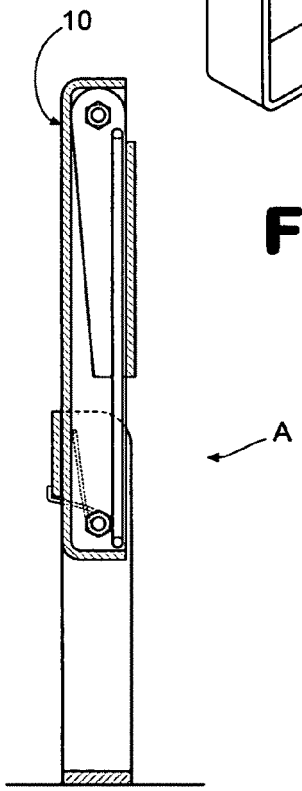
Figure 13:
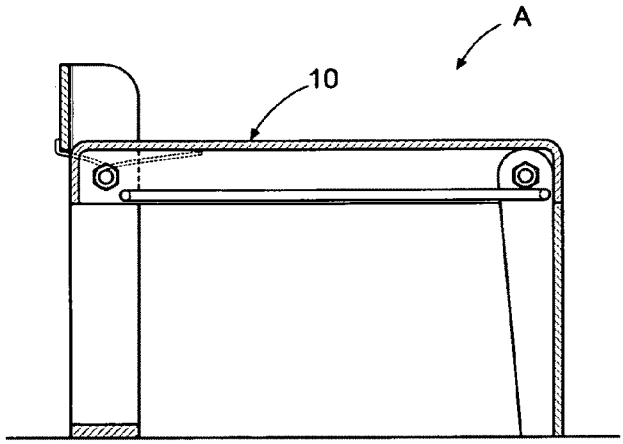
Figure 14:
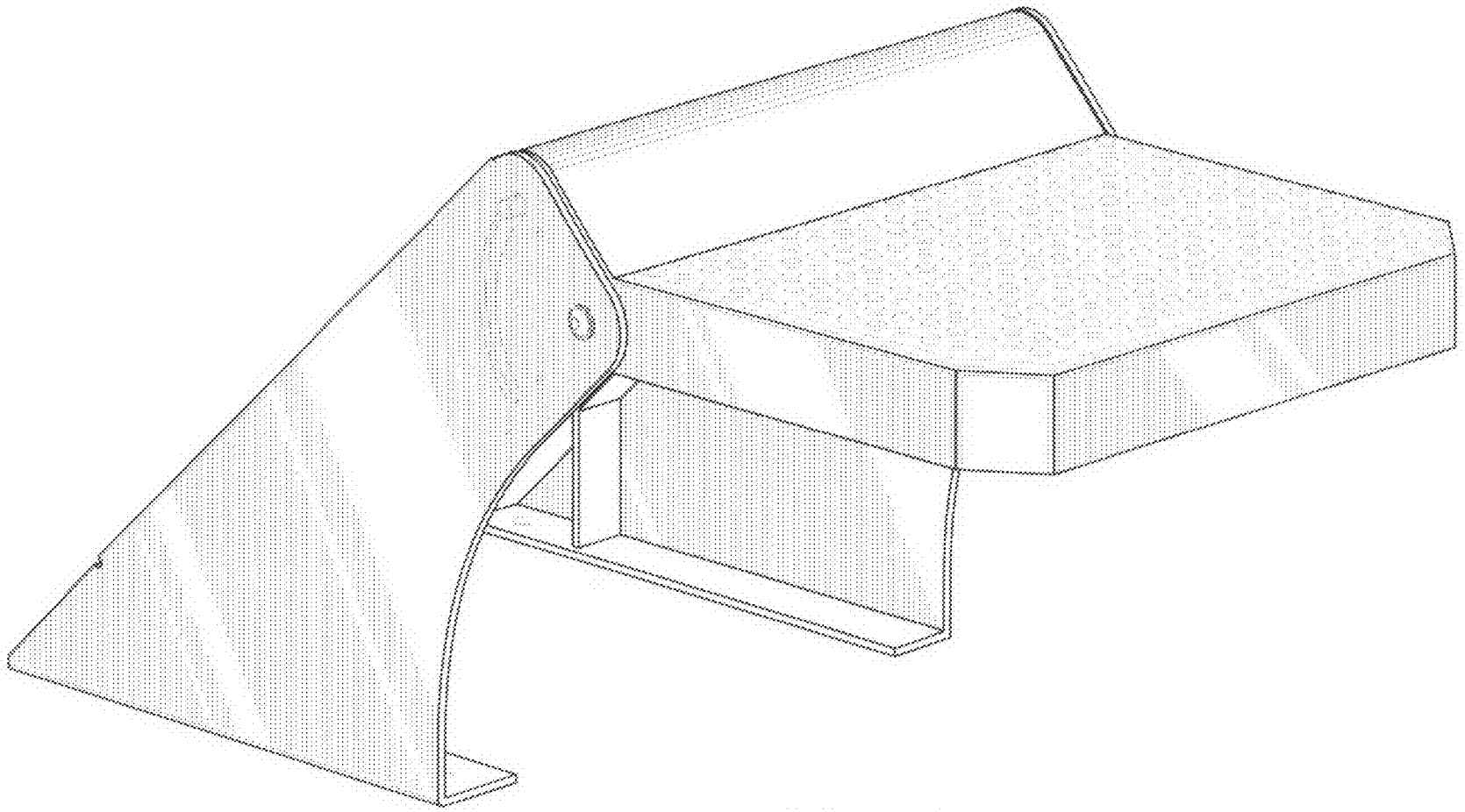
FIGS. 14, 15, 16 and 17 show design features of one of the embodiments of the present invention.
Figure 15:
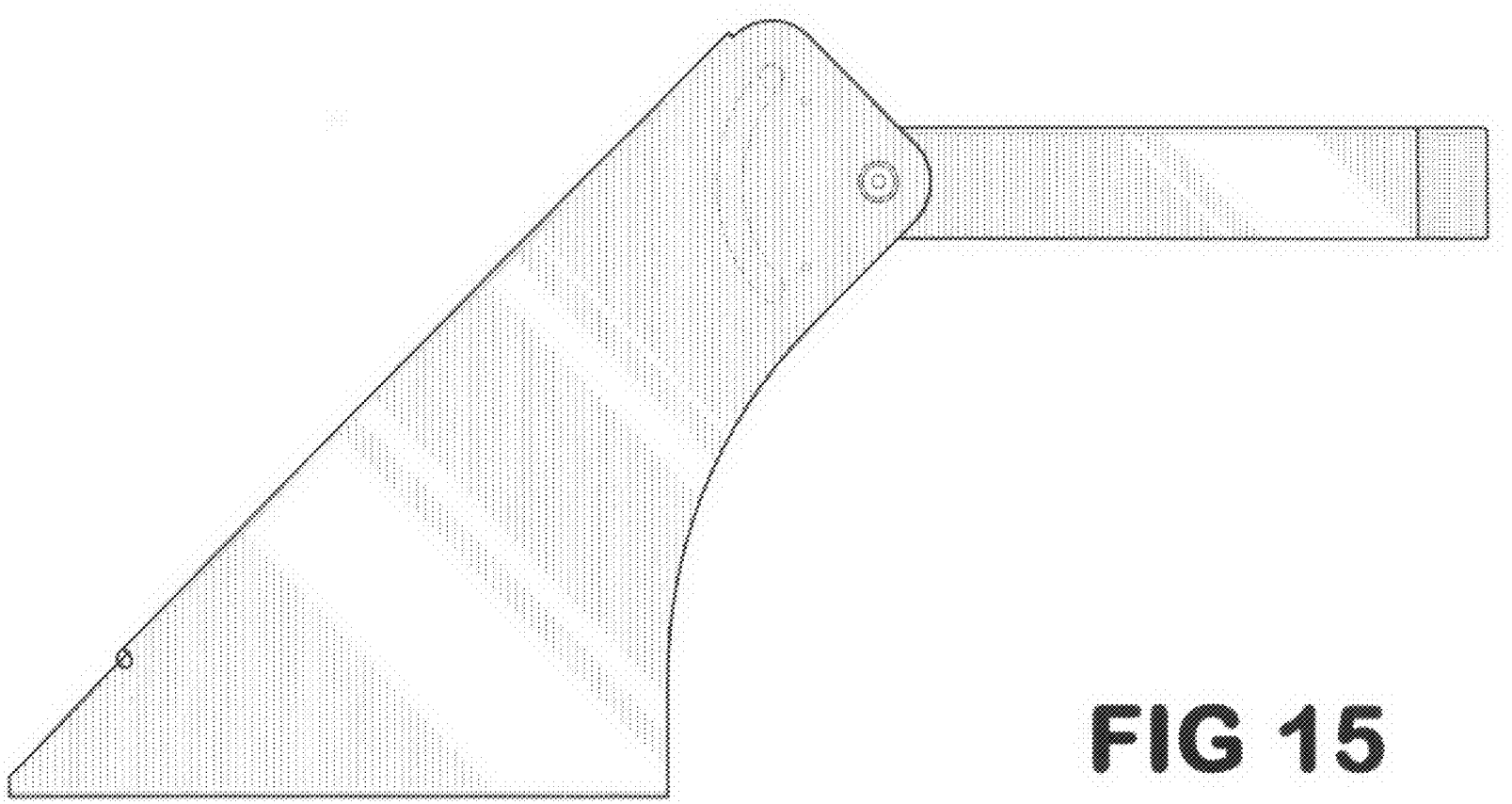
Figure 16:
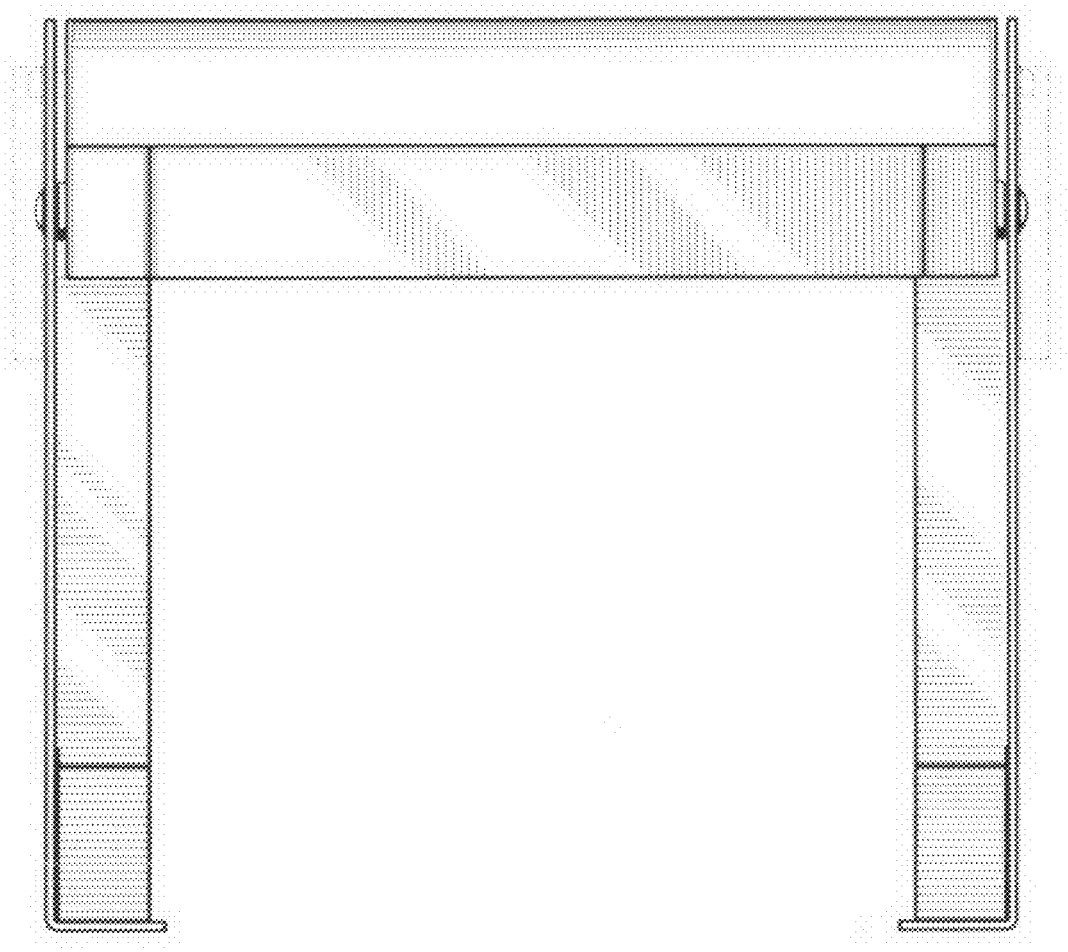
Figure 17:
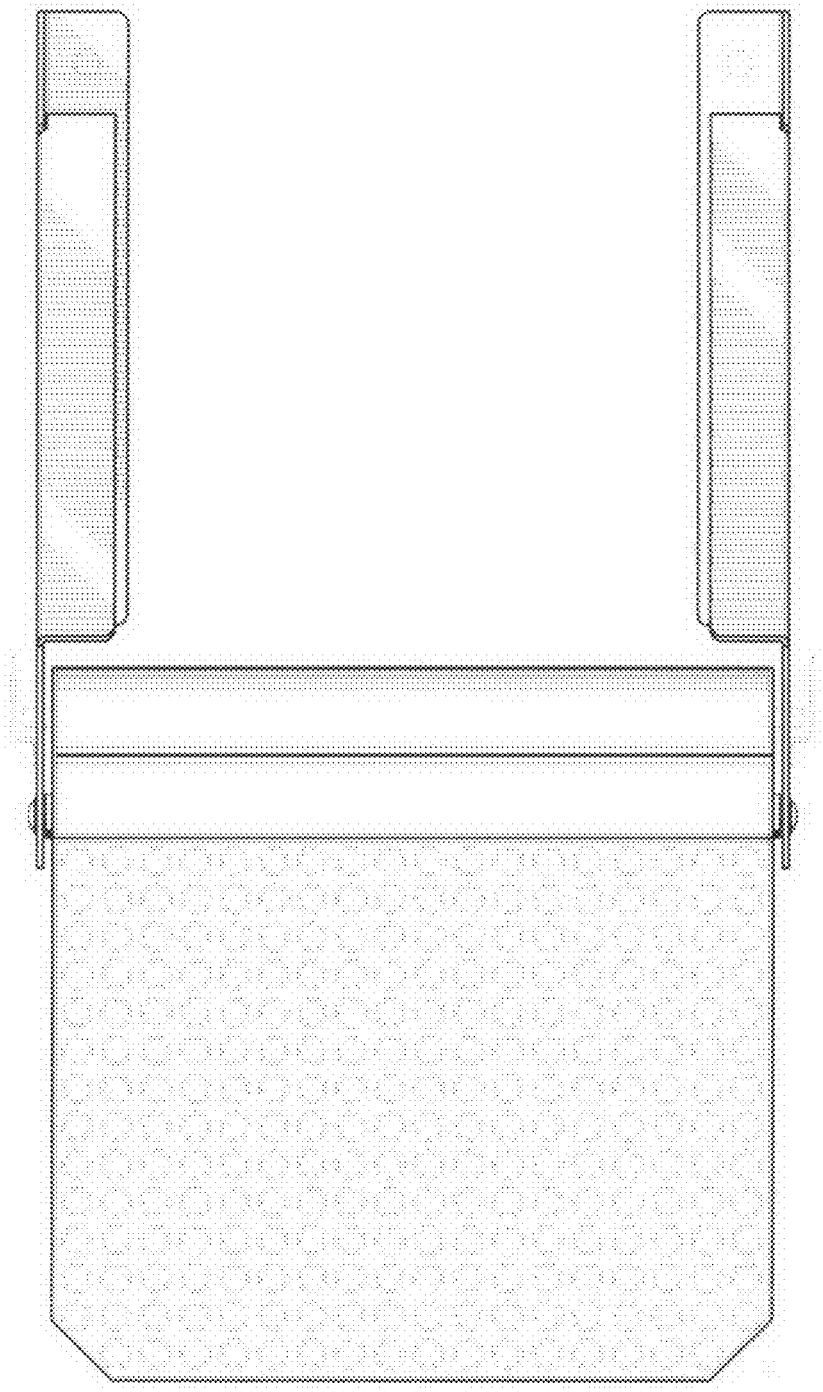

In the embodiment shown in FIGS. 1-3A, the step support mount includes a left side step support member and a right side step support member. Each side step support members include a base portion 14 and an upwardly extending arm portion for carrying a respective side of the step. In one embodiment, the upwardly extending arm portion is disposed closer to the plane defined by the front of the sink than the base member enabling a larger individual to have unimpeded access to the sink as shown in FIG. 3A. In a preferred embodiment, the upwardly extending arm has an arcuate profile wherein the upper portion of the arm is closer than the base to the plane defined by the front of the sink.

In the preferred embodiment, the step includes a pivot rod 60 which is pivotally journeyed to the respective upwardly extending arm portions enabling the step to pivot from the vertical to horizontal position. In the preferred embodiment, a bias 62, biases the step into a vertical position.

FIGS. 5-10 identify additional embodiment of the invention. In these configurations various mounting aspects for mounting a step in position for utilization by a child are shown. In each of these embodiments, two common features are shown. The first is that the step folds from a vertical to horizontal position and the second is that a stop exists for limiting movement of the step between the respective horizontal and vertical positions. Additionally, in each of these embodiments, the step is behind or aligned with the plane defined by the front of the sink when in the vertical position, and the step breaks the plane when in the horizontal position.

Accordingly, what has been shown is a simple solution to a timeless problem, namely, a secure step which is rigidly secured beneath the sink for use in a public restroom and the like, enabling a child to utilize a sink unassisted by an adult. Accordingly, as evidenced by the background, many problems exist regarding restroom designs. Since there is no standard design, various problems exists. These problems range from availability, access and cleanliness. While many of these problems have been addressed, consideration of small children has been lacking. The inconvenience of lifting the children is an all too often occurrence and is sometimes just impractical. An advantageous solution has been presented by the current invention. By providing for a step which is out of the way, taller individuals are not inconvenienced in that they are not required to position themselves in an awkward position to utilize the sink. Such circumstances would exist if the step were permanently affixed in front of the sink as access in front of the sink is common for everyone. However, by positioning the step in alignment with the sink, but outside of the front plane of the sink, a child or diminutive person can readily access the step to elevate themselves in front of the sink faucet.

We claim:

1. In a restroom including walls and a floor, a sink is positioned on one of the walls and above the floor of the restroom, said sink having a front and a back, said sink of a predetermined height and associated profile including a front profile associated with said sink front, wherein said front profile is offset and, generally planar with one of said walls, the improvement comprises a sink access device mounted underneath said sink for enabling a diminutive person to utilize the sink, said sink access device comprising:

a step support mount including a pair of step support members, each having a base member and an upwardly extending arm extending upwardly from said base member, said step support mount fixedly attached to said floor of the restroom via said base members;

a step pivotally mounted to said upwardly extending arms of said step support mount; said step having a first upright position wherein said step is in a vertical position and a second position wherein said step is in a horizontal position providing a platform for a diminutive person to step onto; said step being positioned behind a vertical front plane defined by the front profile of said sink when said step is in said first upright position; said step breaking the plane defined by said front profile of said sink when step is in said second position; and said step being of a predetermined height enabling a diminutive person to utilize said sink when in said second position;

wherein said step includes a generally horizontal stepping surface having a front portion and a rearward portion when said step is in said second position;

at least one travel stop carried by at least one upwardly extending arm, wherein when said step pivots from said first upright position to said second position said step engaged said at least one travel stop thereby stopping said step in said horizontal second position;

wherein said upwardly extending arms being disposed closer to the plane defined by the front profile of said sink than said base member enabling a larger individual to have unimpeded access to the sink, wherein each of said upwardly extending arm has an arcuate profile extending from said base member toward said upper portion of said upwardly extending arm in a manner in which said upper portion of each of said upwardly extending arms is closer to the front plane defined by the front profiled of said sink than said base member of each of said upwardly extending arms thereby presenting said upper portions of said upwardly extending arms in a closer proximity to the front plane defined by the front of said sink than said base members of said upwardly extending arms;

wherein said step includes a spring biasing said step, in said first upright position, behind the front plane defined by the front profile of said sink thereby enabling a larger individual to have unimpeded access to the sink.

2. The sink access device of claim 1 including a first travel stop carried by one of said upwardly extending arms and a second travel stop carried by the other respective upwardly extending arm.

3. The sink access device of claim 1, wherein said step includes at least one arm carried by the rearward portion of said step wherein said arm engages said at least one travel stop thereby stopping said step in said horizontal second position.

* * * * *